United States Patent [19]

Williams, Jr.

[11] 4,268,550

[45] May 19, 1981

[54] METERED FINISH

[75] Inventor: Louis B. Williams, Jr., Walnut Hill, Fla.

[73] Assignee: Monsanto Company, St. Louis, Mo.

[21] Appl. No.: 54,386

[22] Filed: Jul. 2, 1979.

[51] Int. Cl.[3] ..... B05D 1/28

[52] U.S. Cl. ..... 427/429; 118/266; 118/412; 118/420; 427/434.4; 427/434.6

[58] Field of Search ..... 118/420, 412, 266; 427/429, 434 B, 434 D, 434.4, 434.6

[56] References Cited

U.S. PATENT DOCUMENTS

| | | | |
|---|---|---|---|
| 2,032,603 | 3/1936 | Taylor | 118/266 |
| 2,744,563 | 5/1956 | Mennerich | 118/420 |
| 2,781,021 | 2/1957 | Schmitz | 118/266 |

*Primary Examiner*—Ronald H. Smith
*Assistant Examiner*—Janyce A. Bell
*Attorney, Agent, or Firm*—Kelly O. Corley

[57] ABSTRACT

In application of metered finish to a high speed running yarn, a felt plug or other resistance to fluid flow is provided in the finish passageway just prior to the exit.

12 Claims, 5 Drawing Figures

METERED FINISH

The invention relates to the art of metering finish onto a yarn running at high speed.

An essential part of spinning a man-made yarn is application to the yarn of a finish, which is a liquid composition for lubrication, reduction of static electricity, and other functions. Non-uniform application of the finish along the length of the yarn creates various processing problems in subsequent operations on the yarn, and causes defects in products made from the yarn. Finish has commonly been applied by contacting the running yarn with the periphery of a slowly rotating wheel, the lower portion of the wheel being immersed in the finish. This method gives somewhat erratic results.

More recently, attempts have been made to meter the finish to an applicator (commonly known as a "finish pin") in order to improve uniformity of finish application. However when yarn speeds are above 2500 meters per minute, erratic results are frequently obtained when using known commercially available applicators. Applicant has discovered that much of the difficulty arises because of the influence of the turbulent, high speed air entrained with the rapidly moving yarn.

According to a principal aspect of the invention, there is provided in a process for applying finish to a yarn running at least 2500 meters per minute wherein the finish is metered through a passageway just prior to application to the yarn, the improvement comprising inhibiting the variable influence of air travelling with the running yarn upon the finish in the passageway.

According to another principal aspect of the invention, there is provided in combination with a finish applicator wherein finish is metered through a passageway to a yarn running at least 2500 meters per minute, the improvement comprising means for inhibiting the variable influence of air travelling with the running yarn upon the finish in the passageway. The means for inhibiting preferably comprises a resistance to fluid flow in the passageway, and the preferred resistance to fluid flow is a porous element such as a felt interposed in the passageway. The inhibiting means is most effective when located within 5 mm, and preferably no further than 2 mm from the exit of the passageway. Optimally, it fills the exit of the passageway. dr Other aspects will in part appear hereinafter and will in part be obvious from the following detailed disclosure taken in connection with the accompanying drawings, wherein:

Figure 1:
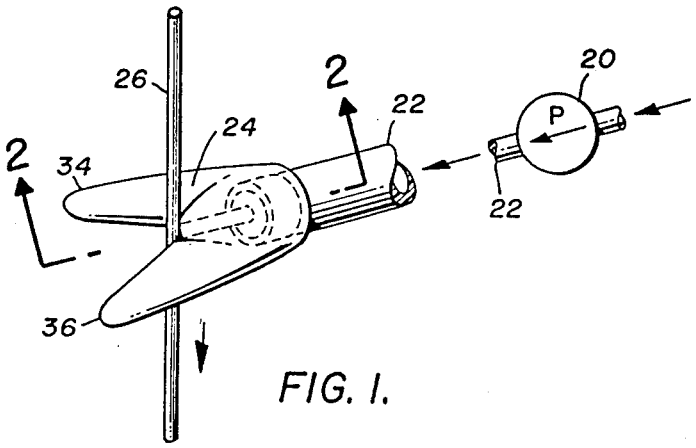
FIG. 1 is a schematic perspective view of a finish metering system.

FIG. 1 schematically shows the general metered finish system. As illustrated, finish is metered at a selected constant rate by metering pump 20 through line 22 to metering pin 24 for application to running yarn 26.

Figure 2:
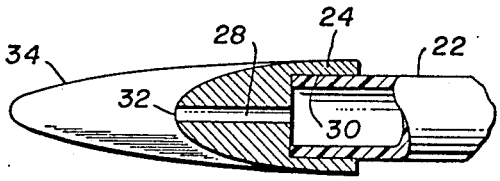
FIG. 2. (PRIOR ART)
FIG. 2 is a sectional view taken along line 2—2 in FIG. 1, showing a generalized prior art finish pin.
Figure 3:
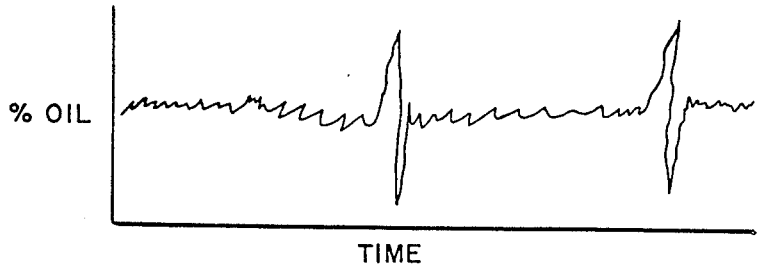
FIG. 3 is a generalized graph showing one type of observed concentration of finish applied on yarn with the FIG. 2 type of finish pin.

When finish pin 24 is constructed according to the prior art, as exemplified by FIG. 2, erratic results are frequently obtained, particularly when yarn 26 is moving at least 2500 meters per minute. In the FIG. 2 construction, a simple right circularly cylindrical fluid passageway 28 extends from the supply end 30 for receiving line 22 to its exit end 32, the latter lying at the bottom of a groove formed between two protruding fingers 34 and 36. Yarn 26 rides in the groove to receive the finish metered through passageway 28. Depending on the diameter of passageway 28, the rate at which pump 20 supplies finish, the speed of yarn 26 and the orientation of yarn 26 with respect to finish pin 24, the resulting concentration of finish on yarn 26 is frequently observed to be erratic rather than substantially constant as is desired. One such pattern is schematically shown in FIG. 3, which is a simplified or stylized representation of charts made using a denier monitoring instrument model M/7000R commercially available from Micro Sensors, Inc., together with head model 708 HC for this instrument from the same manufacturer. The output of this instrument responds not only to yarn denier but also to concentration of finish on yarn. The particular phenomena depicted in FIG. 3 is a normally reasonably constant finish level (fluctuations within a narrow range) followed first by an abrupt increase in finish level well outside the narrow range, then by a sharp decrease to an abnormally low level outside the normal range, then a return to the narrow range. A second such sequence is also shown. Other patterns of deviation from the normal narrow range may be generated, depending on the factors noted above.

It has been discovered that such undesirable deviations may be substantially reduced by inhibiting the variable influence of air entrained or travelling with yarn 26 upon finish in passageway 28. The entrained air is highly turbulent and apparently frequently enters exit end 32 of passageway 28, displacing a quantity of finish before it would normally have left the passageway exit under the urging of pump 20. This would account for the observed abrupt increases in finish level (FIG. 3). Since such action would deplete the finish in the exit end 32, a lower than normal quantity of finish would then be applied to yarn 26 until passageway 28 were again filled with finish by pump 20, thus accounting for the abnormally low levels of finish depicted in FIG. 3. However, regardless of the specific mechanism, inhibition of the variable influence of the entrained air upon finish in passageway 28 has been found to substantially reduce the undesired fluctuations in level of finish applied to yarn 26.

Figure 4:
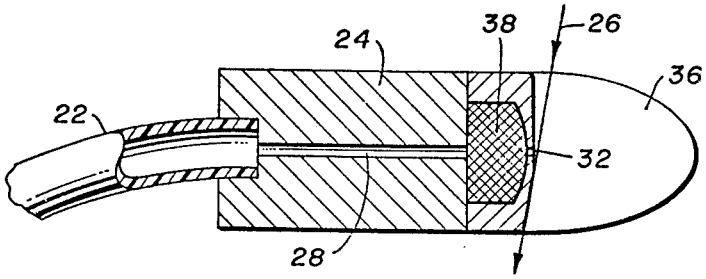
FIG. 4 is a sectional view (similar to FIG. 2) of the preferred embodiment of a finish pin according to the invention.
Figure 5:
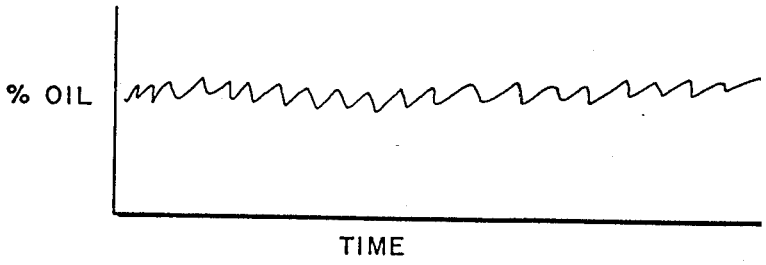
FIG. 5 is a generalized graph of concentration of finish applied on yarn with the FIG. 4 finish pin.

The preferred embodiment of the invention is shown in FIG. 4. As there illustrated, resistance to fluid flow 38 is interposed in passageway 28 as nearly as is practical to exit end 32. The presently preferred resistance to fluid flow is a finely porous element such as a fabric of felt. While optimum results are obtained when resistance 38 entirely fills exit end 32, excellent results are normally obtained when resistance 38 is located no further than 2 mm from the exit of passageway 28, and some benefits of the invention are normally obtained when resistance 38 is located no further than 5 mm from the exit of passageway 28.

What is claimed is:

1. In a process for applying finish to a yarn running at least 2500 meters per minute wherein said finish is metered through a passageway just prior to application to said yarn, the improvement comprising inhibiting the variable influence of air travelling with said running yarn upon said finish in said passageway.

2. In combination with a finish applicator wherein finish is metered through a passageway just prior to application to a yarn, the improvement comprising means for inhibiting the variable influence of air travelling with said running yarn upon said finish in said passageway.

3. The combination defined in claim 2, wherein said means comprises a resistance to fluid flow interposed in said passageway.

4. The combination defined in claim 3 wherein said resistance to fluid flow comprises a porous element interposed in said passageway.

5. The combination defined in claim 2, wherein said means is located within said passageway no further than 5 mm. from the exit of said passageway.

6. The combination defined in claim 5, wherein said means is located within said passageway no further than 2 mm. from the exit of said passageway.

7. The combination defined in claim 3, wherein said means is located within said passageway no further than 5 mm. from the exit of said passageway.

8. The combination defined in claim 3, wherein said means is located within said passageway no further than 2 mm. from the exit of said passageway.

9. The combination defined in claim 4, wherein said means is located within said passageway no further than 5 mm. from the exit of said passageway.

10. The combination defined in claim 4, wherein said means is located within said passageway no further than 2 mm. from the exit of said passageway.

11. The combination defined in claim 3, wherein said means fills the exit of said passageway.

12. The combination defined in claim 4, wherein said means fills the exit of said passageway.

* * * * *